United States Patent [19]

Kmiecik-Lawrynowicz et al.

[11] Patent Number: 5,045,422

[45] Date of Patent: Sep. 3, 1991

[54] ENCAPSULATED TONER COMPOSITIONS

[75] Inventors: Grazyna Kmiecik-Lawrynowicz, Burlington; Beng S. Ong; Fernando Yulo, both of Mississauga, all of Canada

[73] Assignee: Xerox Corporation, Stamford, Conn.

[21] Appl. No.: 395,689

[22] Filed: Aug. 18, 1989

[51] Int. Cl.[5] ..... G03G 9/00; G03C 1/72

[52] U.S. Cl. ..... 430/109; 430/138

[58] Field of Search ..... 430/138, 109

[56] References Cited

U.S. PATENT DOCUMENTS

| | | | |
|---|---|---|---|
| 3,965,022 | 6/1976 | Strong et al. | 252/62.1 P |
| 4,016,099 | 4/1977 | Wellman et al. | 252/316 |
| 4,142,982 | 3/1979 | Yamakami et al. | 252/62.1 P |
| 4,254,201 | 3/1981 | Sawai et al. | 430/111 |
| 4,265,994 | 5/1981 | Hasegawa et al. | 430/107 |
| 4,339,518 | 7/1982 | Okamura et al. | 430/126 |
| 4,388,396 | 6/1983 | Nishibayashi et al. | 430/126 |
| 4,497,885 | 2/1985 | Ushiyama et al. | 430/106.6 |
| 4,520,091 | 5/1985 | Kakimi et al. | 430/110 |
| 4,590,142 | 5/1986 | Yamazaki et al. | 430/138 |
| 4,599,289 | 7/1986 | Suematsu et al. | 430/98 |
| 4,642,281 | 2/1987 | Kakimi et al. | 430/138 |
| 4,708,924 | 11/1987 | Nagai et al. | 430/138 |
| 4,740,443 | 4/1988 | Nakahara et al. | 430/106.6 |
| 4,770,968 | 9/1988 | Georges et al. | 430/108 |
| 4,803,144 | 2/1989 | Hosoi | 430/106.6 |
| 4,814,253 | 3/1989 | Gruber et al. | 430/106.6 |
| 4,851,318 | 7/1989 | Hseih et al. | 430/187 |
| 4,916,188 | 11/1990 | Reising | 525/124 |

FOREIGN PATENT DOCUMENTS

| | | | |
|---|---|---|---|
| 0052640 | 4/1977 | Japan | 430/138 |
| 1056352 | 3/1986 | Japan | 430/138 |

*Primary Examiner*—Marion E. McCamish
*Assistant Examiner*—Steven Crossan
*Attorney, Agent, or Firm*—E. O. Palazzo

[57] ABSTRACT

An encapsulated toner composition comprised of a core with a fluorocarbon-incorporated resin binder, pigment or dyes, and a polymeric shell.

41 Claims, No Drawings

ENCAPSULATED TONER COMPOSITIONS

BACKGROUND OF THE INVENTION

The present invention is generally directed to toner compositions, and more specifically to encapsulated toner compositions. In one embodiment the present invention is related to encapsulated toner compositions comprised of a core containing a fluorocarbon-incorporated resin binder, that is for example a copolymer of a fluorocarbon and a monomer subsequent to polymerization, and colorants with a polymeric shell thereover preferably prepared by interfacial polymerization. Another specific embodiment of the present invention relates to encapsulated toner compositions comprised of a core containing a fluorocarbon-incorporated polymer resin such as those derived from the copolymerization of a suitably functionalized fluorocarbon compound with an addition-type monomer, and dye or pigment particles, which core is encapsulated by a polymeric coating such as a polyurea, a polyurethane, a polyamide, a polyester, or mixtures thereof. Examples of advantages associated with the toner compositions of the present invention include the elimination and/or the minimization of image ghosting, excellent fixing characteristics, acceptable release properties enabling selection of the toners, for example, in imaging systems wherein a release fluid such as a silicone oil can be avoided, substantially no toner agglomeration, acceptable powder flow characteristics, and avoidance or minimization of core binder adherence to imaging components such as, for example, photoreceptors and dielectric receivers. The toner compositions of the present invention can be selected for a variety of known imaging processes including electrophotographic and ionographic processes. Preferably, the toner compositions are selected for pressure fixing processes in ionographic printing devices wherein dielectric receivers such as silicon carbide are utilized, reference U.S. Pat. No. 4,885,220 entitled Amorphous Silicon Carbide Electroreceptors, the disclosure of which is totally incorporated herein by reference. The toner compositions of the present invention can be selected for commercial ionographic printers such as the Delphax S9000 S6000, S4500, S3000, Xerox 4075 TM wherein, for example, transfixing is utilized, that is fixing of the developed image is accomplished by simultaneously transferring and fixing the developed images with pressure. In another specific embodiment of the present invention the toners possess high fixing characteristics enabling their selection for duplex imaging processes. Moreover, in other embodiments of the present invention the toners thereof possess acceptable powder flow and surface release properties, thus enabling efficient transfer of toned images to paper substrate, and eliminating or substantially suppressing image ghosting problems. The desirable surface release properties of the toner compositions of the present invention also enable their use in pressure fixing and thermal energy fusing processes without the use of a release agent, such as a silicone oil, to prevent image offset to the pressure or fuser rolls.

The toner compositions of the present invention can in one specific embodiment, be prepared by the interfacial polymerization of shell-forming monomers, followed by in situ free-radical polymerization of core binder-forming monomers. Thus, in one embodiment the present invention is directed to a process for the simple, and economical preparation of pressure fixable encapsulated toner compositions by interfacial/free-radical polymerization methods wherein there are selected as core monomers an addition-type monomer or monomers, and an addition-polymerizable fluorocarbon compound. Other process embodiments of the present invention relate to, for example, interfacial/free-radical polymerization processes for obtaining encapsulated colored toner compositions. Further, in another process aspect of the present invention the encapsulated toners can be prepared without organic solvents thus eliminating explosion hazards associated therewith; and therefore, these processes do not require expensive and hazardous solvent separation and recovery steps. Moreover, with the aforementioned process of the present invention there is obtained in some instances improved throughput yield per unit volume of reactor size since, for example, the extraneous solvent component can be replaced by liquid core monomer(s) which would serve as a diluting vehicle and as a reaction medium. The aforementioned toners prepared in accordance with the process of the present invention are useful for permitting the development of images in reprographic imaging systems, inclusive of electrophotographic and ionographic processes wherein pressure fixing, especially pressure fixing in the absence of heat, is selected.

Encapsulated and cold pressure fixable toner compositions are known. Cold pressure fixable toners have a number of advantages in comparison to toners that are fused by heat, primarily relating to the utilization of less energy since the toner compositions used can be fixed at room temperature. Nevertheless, many of the prior art cold pressure fixable toner compositions suffer from a number of deficiencies. For example, these toner compositions must usually be fixed under high pressure, which has a tendency to severely disrupt the toner's fixing characteristics. This can result in images of low resolution, or no images whatsoever. The high fixing pressure can also lead to objectionable paper calendering and glossy images. With some of the prior art cold pressure toner compositions, substantial image smearing can result from the high pressures used. Additionally, the cold pressure fixing toner compositions of the prior art have other disadvantages in that, for example, these compositions generate images of inferior crease and rub resistance properties, and the said images can often be readily rubbed off with pressure or removed by folding. Furthermore, many of the prior art toner compositions are prepared by processes which employ organic solvents as diluting vehicles and as reaction media, and these may create explosion hazards; and further these processes will be costly because they require the additional solvent separation and recovery steps. Furthermore, with many of the prior art processes narrow size dispersity particles cannot easily be achieved by conventional bulk homogenization techniques as contrasted with the process of the present invention wherein narrow size dispersity particles are easily obtained. In addition, many prior art processes provide deleterious effects on toner particle morphology and bulk density as a result of the removal of solvent and the subsequent collapse or shrinkage of toner particles during particle isolation resulting in a toner of very low bulk density, which disadvantages are substantially eliminated with the process of the present invention. More specifically, thus with the encapsulated toners of the present invention control of the properties of both the core and shell materials can be achieved. Specifically, with the encapsulated toners of the present invention image ghosting is eliminated in many instances primarily because of the chemical reaction presence of certain fluorocarbon moieties in the core binder structure illustrated herein. Image ghosting is one of the undesirable print quality problems encountered in ionographic printing processes. It refers to the repetitious printing of unwarranted images, and is related to the contamination of the dielectric receiver surface by some unremoved residual toner materials. The toner compositions of the present invention effectively prevent the aforementioned contamination by imparting desirable and acceptable surface release properties to toners, thus enabling efficient transfer of developed images and efficient cleaning of dielectric receiver surface.

In a patentability search report, the following prior art U.S. Pat. Nos. were recited: 4,339,518, which relates to a process of electrostatic printing with fluorinated polymer toner additives where suitable materials for the dielectric toner are thermo plastic silicone resins and fluorine containing resins having low surface energy, reference column 4, beginning at line 10, note for example the disclosure in column 4, line 16, through column 6; 4,016,099, which discloses methods of forming encapsulated toner particles and wherein there is selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18; 4,265,994 directed to pressure fixable capsule toners with polyolefins, such as polytetrafluoroethylene, see for example column 3, beginning at line 15; 4,497,885, which discloses a pressure fixable microcapsule toner comprising a pressure fixable component, a magnetic material, and other optional components, and wherein the core material can contain a soft material typical examples of which include polyvinylidenefluoride, polybutadiene, and the like, see column 3, beginning at line 10; 4,520,091 discloses an encapsulated toner with a core which comprises a colorant, a dissolving solvent, a nondissolving liquid and a polymer, and may include additives such as fluorine containing resin, see column 10, beginning at line 27; 4,590,142 relating to capsule toners wherein additives such as polytetrafluoroethylenes are selected as lubricating components, see column 5, beginning at line 52; 4,599,289 and 4,803,144.

With further specific reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

Illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676 (now abandoned), the disclosure of which is totally incorporated herein by reference. In the aforementioned application, the core can be comprised of magnetite and a polyisobutylene of a specific molecular weight encapsulated in a polymeric shell material generated by an interfacial polymerization process.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as polyvinyl pyrrolidone. Additionally, there are described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Accordingly, there is a need for encapsulated toner compositions with many of the advantages illustrated herein. More specifically, there is a need for encapsulated toners wherein image ghosting is eliminated or minimized. Also, there is a need for encapsulated toners which provide high image fix levels, and which compositions enable, for example, their selection for use in duplex imaging processes. Moreover, there is a need for encapsulated toners, including colored toners wherein image ghosting, toner offsetting, and the like are avoided or minimized. Additionally, there is a need for encapsulated toners, including colored toners with excellent release characteristics enabling their selection in imaging systems without having to use surface release fluids such as silicone oils to prevent image offsetting to the fixing or fusing roll. Furthermore, there is a need for encapsulated toners, including colored toners with substantially no toner agglomeration, and extended shelf life exceeding, for example, one to two years. Also, there is a need for encapsulated toners that have been surface treated with additives such as carbon blacks, graphite or the like to impart to their surfaces certain conductivity characteristics such as a volume resistivity of from about $1\times10^{5}$ ohm-cm to about $1\times10^{8}$ ohm-cm. Conductive toners enable the desirable single component inductive development processes currently selected for many ionographic printers. Furthermore, there is a need for encapsulated toners wherein surface additives, such as metal salts or metal salts of fatty acids and the like, are utilized to assist in the release of the toned images from the imaging component such as a photoreceptor or a dielectric receiver to paper substrate. There is also a need for simple, economical processes for the preparation of encapsulated toners. Specifically, there is a need for interfacial/free-radical polymerization processes for black and colored encapsulated toner compositions, wherein the core contains colorants, and a fluorocarbon-incorporated core binder derived from two core monomers or precursors, one of which is an addition-polymerizable fluorocarbon compound. Another need resides in the provision of a simple economical process wherein in some embodiments organic solvents are not employed as the diluting vehicles or as reaction media. Furthermore, there is a need for improved processes that will enable pressure fixable toner compositions with pressure-rupturable hard shells, pressure-fixable soft cores, and wherein the properties of the toner's constituent materials such as the core binder molecular weight and molecular weight dispersity can be desirably controlled. Moreover, there is a need for enhanced flexibility in the design and selection of materials comprising the core and shell of toner particles, and the control of the physical properties, such as bulk density, particle size, and size dispersity of the toner.

SUMMARY OF THE INVENTION

It is an object of the present invention to provide encapsulated toner compositions with many of the advantages illustrated herein.

In another object of the present invention there are provided encapsulated toner compositions comprised of a core of fluorocarbon-incorporated polymer resin binder, pigments and/or dyes and thereover a shell prepared, for example, by interfacial polymerization.

Another object of the present invention is the provision of encapsulated toners wherein image ghosting is eliminated in some embodiments, or minimized in other embodiments.

Further, another object of the present invention is the provision of encapsulated toners wherein toner agglomeration is eliminated in some embodiments, or minimized in other embodiments.

Also, another object of the present invention is the provision of encapsulated toners wherein the core component leaching or loss is eliminated in some embodiments, or minimized in other embodiments.

Moreover, another object of the present invention is the provision of encapsulated toners wherein toner offsetting is eliminated in some embodiments, or minimized in other embodiments.

Additionally, another object of the present invention is the provision of encapsulated toners with extended shelf life without substantially any modifications of the toner characteristics thereof.

Further, another object of the present invention is the provision of encapsulated toners with excellent release properties.

Also, another object of the present invention is the provision of colored, that is other than black, encapsulated toners.

It is another object of the present invention to provide encapsulated toners wherein contamination of the imaging member, such as a dielectric receiver including electroceptors, is eliminated or minimized.

Another object of the present invention is the provision of encapsulated toners that can be selected for imaging processes, especially processes wherein pressure fixing is selected.

In another object of the present invention there are provided simple, and economical processes for black and colored toner compositions formulated by an interfacial/free-radical polymerization process in which the shell formation (interfacial polymerization), core formation (free-radical polymerization), and resulting material properties can be independently controlled in some embodiments.

Another object of the present invention resides in the provision of simple, and economical processes for the preparation of black, and colored pressure fixable toner compositions.

Another object of the present invention resides in processes for toner compositions with high bulk density, for example about 0.7 to about 1.2 grams/cc.

These and other objects of the present invention are accomplished by the provision of toners, and more specifically encapsulated toners. In one embodiment of the present invention, there are provided encapsulated toners with a core containing colorants and a fluorocarbon-incorporated core resin binder, and a polymeric shell thereover. Specifically, in one embodiment there are provided, in accordance with the present invention, encapsulated toners comprised of a core containing a fluorocarbon-incorporated, that is wherein the fluorocarbon is permanently associated by, for example, chemical processes with the polymer core binder, pigment or dye, and thereover a shell preferably obtained by interfacial polymerization.

The aforementioned toners of the present invention can be prepared by a number of different processes including the interfacial/free-radical polymerization process which comprises (1) mixing or blending of a core monomer or monomers, a functionalized fluorocarbon compound, free-radical initiator, pigment, and a shell monomer or monomers; (2) dispersing the resulting mixture of materials by high shear blending into stabilized microdroplets in an aqueous medium with the assistance of suitable dispersants or emulsifying agents; (3) thereafter subjecting the aforementioned stabilized microdroplets of, for example, a specific droplet size and size distribution to a shell forming interfacial polycondensation; and (4) subsequently forming the core binder by heat-induced free-radical polymerization within the newly formed microcapsules. The shell forming interfacial polycondensation is generally accomplished at ambient temperature, however, elevated temperatures may also be employed depending on the nature and functionality of the shell monomer selected. For the core binder forming free-radical polymerization, heating thereof is generally effected at a temperature of from ambient temperature to about 100° C., and preferably from ambient temperature to about 85° C. In addition, more than one initiator may be utilized to enhance the polymerization conversion, and to generate the desired core copolymer binder molecular weight and molecular weight distribution.

In accordance with the present invention, there are also provided preparative processes for black and colored pressure fixable toner compositions which are obtained without the use of an organic solvent. These processes involve dispersing a mixture of organic materials and colorants to form stabilized microdroplets in an aqueous medium containing a dispersant or emulsifying agent. The organic mixture is comprised of from about 20 to about 50 percent by weight of a core monomer, about 0.5 to about 20 percent of a suitably functionalized fluorocarbon compound, about 5 to about 65 percent of a colorant or colorants, about 1 to about 30 percent of a shell forming monomer component, and a free-radical initiator. The shell formation around the dispersed, stabilized microdroplets via interfacial polycondensation is initiated by adding another or second shell forming, water-miscible monomer component into the aqueous phase. Subsequently, the reaction mixture is subjected to heating to initiate free-radical polymerization of a core monomer to form core fluorocarbon copolymer binder within the newly formed microcapsules.

Examples of core monomers selected present in effective amounts of, for example, from about 10 to about 99.5 weight percent that are subsequently polymerized include, but are not limited to, addition-type monomers such as propyl acrylate, propyl methacrylate, butyl acrylate, butyl methacrylate, pentyl acrylate, pentyl methacrylate, hexyl acrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, heptyl acrylate, heptyl methacrylate, isobutyl acrylate, isobutyl methacrylate, methylbutyl acrylate, methylbutyl methacrylate, tolyl acrylate, tolyl methacrylate, styrene, dodecyl styrene, hexyl methyl styrene, nonyl styrene, tetradecyl styrene, or other substantially equivalent addition monomers. Suitable functionalized fluorocarbon compounds that can be selected for incorporation into, that is for example reacted with, the core binder structure include appropriate fluorocarbon compounds capable of undergoing addition polymerization, provided they can copolymerize with the core monomers to afford the fluorocarbon-incorporated core binder resins. The functionalized fluorocarbon compounds can be employed in an effective amount of, for example, from about 0.5 percent to about 35 percent by weight of the resultant core binder, and preferably from about 1 percent to about 10 percent by weight of the resultant core copolymer binder.

Examples of available functionalized fluorocarbon compounds that can be selected for the preparation of the toner compositions of the present invention, and more specifically the fluorocarbon incorporated core binder can be represented by the following general Formula (I):

$$A-(CF_2)_x-B \qquad (I)$$

where A is a structural moiety containing an addition-polymerization functionality such as an acryloxy, methacryloxy, styryl, or other vinyl function capable of undergoing addition polymerization, preferably free-radical polymerization; B is a fluorine atom or a structural moiety containing an addition-polymerization functionality as described herein for A; and x is the number of difluoromethylene groups of, for example, from 1 to about 50, and preferably from about 2 to about 20.

Illustrative specific examples of the functionalized fluorocarbon compounds that can be utilized in an effective amount, for example in one embodiment in an amount of from about 1 percent to about 20 percent by weight of the total core binder precursors used, include the commercially available acryloxy-functionalized fluorocarbon compounds and methacryloxy-functionalized fluorocarbon compounds represented by the following Formulas (II), (III), (IV) and (V) wherein R is hydrogen or alkyl; R′ is alkylene, arylene, or the derivatives thereof; and x represents the number of difluoromethylene segments, for example, x can be a number from about 1 to about 50, and preferably from about 2 to about 20:

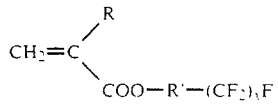
(II)

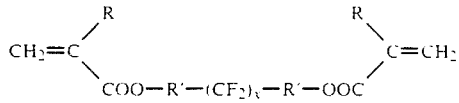
(III)

$$CH_2=CH-C_6H_5-R'-(CF_2)_x-F \qquad (IV)$$

$$CH_2=CH-C_6H_5-R'-(CF_2)_x-R'-C_6H_5-CH=CH_2 \qquad (V)$$

More specifically, the aforementioned low surface energy fluorocarbon compounds selected are copolymerized with appropriate addition-type monomers for the formation of the fluorocarbon-incorporated core copolymer binder of the toner compositions of the present invention.

Examples of alkyl groups include those containing from about 1 to about 20 carbon atoms, preferably including methyl or ethyl. Alkylene functions are those containing 1 to about 20 carbon atoms such as methylene, dimethylene, trimethylene, tetramethylene, 2,2-dimethyltrimethylene, 2-methyltetramethylene, and the like, with the preferred alkylene functions being methylene, dimethylene and trimethylene. Arylene examples include those with from 6 to about 24 carbon atoms such as phenylene, tolylene, 1,4-dimethylenebenzene, p-(methylenephenyl)dimethylene, and the like, with the preferred arylene being phenylene or tolylene. Both the aforementioned alkylenes and arylenes can be substituted with other substituents such as halogen, cyano, alkoxy, aryloxy functions and the like. The aforementioned functionalized fluorocarbon compounds are readily available, thus, for example, acryloxy-based Zonyl TA-N, and methacryloxy-based Zonyl TM are available from of E. I. DuPont.

Illustrative examples of core monomers preferably present in an amount of from about 65 to about 99.5 percent by weight of the total core binder precursors include, as indicated herein, acrylates, methacrylates, styrene monomers, and the like. Specific examples of core monomers are n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, dodecyl styrene, hexylmethyl styrene, nonyl styrene, tetradecyl styrene, other known vinyl monomers, reference for example U.S. Pat. No. 4,298,672, the disclosure of which is totally incorporated herein by reference, and the like.

Various known colorants present in the core in an effective amount of, for example, from about 2 to about 75 percent by weight of toner, and preferably in an amount of from about 5 to about 60 percent by weight can be selected inclusive of carbon black, magnetites, such as Mobay magnetites MO8029, MO8060; Columbian magnetites Mapico Blacks and surface treated magnetites; Pfizer magnetites, CB4799, CB5300, CB5600, MCX6369; Bayer magnetites Bayferrox 8600, 8610; Northern Pigments magnetites NP-604, NP-608; Magnox magnetites TMB-100 or TMB-104; and other equivalent black pigments. As colored pigments there can be selected red, blue, brown, green, Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E. D. Toluidine Red and Bon Red C available from Dominion Color Corporation, Ltd., Toronto, Ontario, NOVAperm Yellow FGL, Hostaperm Pink E from Hoechst, Cinquasia Magenta available from E. I. DuPont de Nemours & Company, and the like. Generally, colored pigments that can be selected include cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido)phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, and Permanent Yellow FGL. The aforementioned pigments are incorporated into the microencapsulated toner compositions in various suitable effective amounts. In one embodiment, these colored pigment particles are present in the toner composition in an amount of from about 2 percent by weight to about 65 percent by weight calculated on the weight of the dry toner. Colored magnetites, such as mixtures of Mapico Black, and cyan components may also be used as pigments for the toners of the present invention.

Examples of shell polymers include polyureas, polyamides, polyesters, polyurethanes, mixtures thereof, and polycondensation products of polyisocyanates and polyamines as illustrated in U.S. Pat. No. 4,877,706, entitled Single Component Cold Pressure Fixable Encapsulated Toner Compositions, the disclosure of which is totally incorporated herein by reference, and the like. The shell amounts are generally present in effective amounts of, for example, from about 5 to about 25 percent by weight of the toner, and have a thickness generally, for example, of less than about 5 microns, and more specifically from about 0.1 micron to about 3 microns. Other shell polymers, shell amounts, and thicknesses can be selected.

The shell forming monomer components present in the organic phase are generally comprised of diisocyanates, diacyl chloride, bischloroformate, together with appropriate polyfunctional crosslinking agents such as triisocyanate, triacyl chloride and other polyisocyanates. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. The water-soluble, shell forming monomer components in the aqueous phase can be a polyamine or a polyol including bisphenols. Illustrative examples of water soluble shell monomers include ethylenediamine, triethylenediamine, diaminotoluene, diaminopyridine, bis(aminopropyl)piperazine, bisphenol A, bisphenol Z, and the like. When desired, a water soluble crosslinking agent, such as triamine or triol, can also be added to improve the mechanical strength of the polymeric shell structure. Shell examples are detailed in U.S. Pat. No. 4,877,706, the disclosure of which is totally incorporated herein by reference.

In one specific embodiment of the present invention, there is provided an improved process for the preparation of encapsulated toner compositions, which process comprises mixing and dispersing a core monomer, a functionalized fluorocarbon compound, a free-radical initiator, pigment particles or dyes, and a shell monomer into microdroplets of specific droplet size and size distribution in an aqueous medium containing a dispersant or stabilizer; the volume average microdroplet diameter generally being from about 5 microns to about 30 microns, and the volume average droplet size dispersity being from about 1.2 to about 1.4 as determined from Coulter Counter measurements of the microcapsule particles after encapsulation; forming a microcapsule shell around the microdroplets via interfacial polymerization by adding a water soluble shell forming monomer component; and subsequently affecting a free-radical polymerization to form a copolymer core binder resin within the newly formed microcapsules by, for example, heating the reaction mixture from room temperature to about 100° C. for a period of from about 1 to about 10 hours. Stabilizers selected for the process of the present invention include, but are not limited to, polymeric water soluble high molecular weight polymers such as poly(vinyl alcohols), methyl cellulose, hydroxypropylcellulose, and the like. Illustrative examples of free-radical initiators selected for the preparation of the toners of the present invention include azo compounds such as 2,2'-azodimethylvaleronitrile, 2,2'-azoisobutyronitrile, azobiscyclohexanenitrile, 2-methylbutyronitrile, mixtures thereof, and the like, with the quantity of initiator(s) being, for example, from about 0.5 percent to about 10 percent by weight of that of core monomer(s).

Interfacial polymerization processes selected for the shell formation of the toners of the present invention are as illustrated, for example, in U.S. Pat. Nos. 4,000,087 and 4,307,169, the disclosures of which are totally incorporated herein by reference.

Surface additives can be selected for the toners of the present invention including, for example, metal salts, metal salts of fatty acids, colloidal silicas, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil.

Also, the toner compositions of the present invention can be rendered relatively conductive with, for example, a volume resistivity of from about $5\times10^3$ ohm-cm to about $5\times10^8$ ohm-cm by adding to the surface thereof components such as carbon blacks, graphite, and other conductive materials in an effective amount of from, for example, about 0.1 percent to about 8 percent by weight of the toner product, and preferably from about 1 percent to about 6.5 percent by weight of toner. The conductive toner surface enables the use of inductive development systems such as those in the commercial Delphax printer machines.

For two component developers, carrier particles including steel ferrites, copper zinc ferrites, and the like, with or without coatings, can be admixed with the encapsulated toners of the present invention, reference for example the carriers illustrated in U.S. Ser. No. 136,791/87; U.S. Pat. No. 4,937,166 and U.S. Pat. No. 4,935,326; U.S. Pat. Nos. 4,560,635; 4,298,672; 3,839,029; 3,847,604; 3,849,182; 3,914,181; 3,929,657 and 4,0402,518, the disclosures of which are totally incorporated herein by reference.

The following examples are being submitted to further define various species of the present invention. These examples are intended to be illustrative only and are not intended to limit the scope of the present invention. Also, parts and percentages are by weight unless otherwise indicated.

EXAMPLE I

A 17.1 micron (average volume diameter in each instance) conductive black encapsulated toner comprising a fluorocarbon-incorporated poly(lauryl methacrylate) core binder was prepared as follows.

A mixture of 120 grams of lauryl methacrylate (available as Rocryl 320 from Rohm and Haas), 13.3 grams of Zonyl TM fluorocarbon, 3.30 grams each of 2,2'-azobis-(2,4-dimethylvaleronitrile) and 2,2'-azobis(isobutyronitrile), and a solution of 47.1 grams of Isonate 143 L in 20 milliliters of dichloromethane was mixed in a 2-liter Nalgene container with a Brinkmann polytron equipped with a PT 35/4 probe at 4,000 rpm for 30 seconds. Two hundred and eighty (280) grams of Northern Pigments magnetite NP-608 was then added, and the resulting mixture was homogenized by high sheer blending with the Brinkmann polytron at 8,000 rpm for 3 minutes. To the mixture was then added 1 liter, 0.18 percent, (by weight) of an aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 37 milliliters of 1,4-bis-(3-aminopropyl)piperazine in 80 milliliters of water was then added with constant stirring for 10 minutes to initiate the microcapsule shell forming reaction. Subsequently, the mixture was transferred to a 3-liter reaction kettle and was mechanically stirred at room temperature for approximately 1 hour to complete the shell forming polycondensation reaction. Thereafter, the mixture was heated in an oil bath to initiate the core binder-forming free radical polymerization. The temperature of the reaction mixture was gradually increased from room temperature to a temperature of 85° C. over a period of 1 hour. Heating was continued at this temperature for an additional 6 hours before the mixture was cooled to room temperature. After the reaction, the microcapsule toner product was transferred to a 4-liter beaker, and washed repeatedly with water until the washing was clear, and the encapsulated toner product resulting was then sieved through a 180 micron sieve to remove coarse material. The wet encapsulated toner was then transferred to a 2-liter beaker and was diluted with water to a total volume of 1.8 liter. Colloidal graphite, 21.2 grams, Aquadag E obtained from Acheson Colloids, diluted with 100 milliliters water, was added to the beaker, and the mixture was spray dried in a Yamato Spray Dryer at an air inlet temperature of 160° C., and an air outlet temperature of 80° C. The air flow was retained at 0.75 millimeters$^3$/minute, while the atomizing air pressure was retained at 1.0 kilograms/cm$^2$. The collected encapsulated dry toner (363 grams) was screened through a 63 micron sieve; the toner's volume average particle diameter, as measured on a 256 channel Coulter Counter, was 17.1 microns with a volume average particle size dispersity of 1.31.

Two hundred and forty (240) grams of the above encapsulated toner was dry-blended using a Greey blender, first with 0.96 gram of carbon black (Black Pearls 2000) for 2 minutes with the blending impeller operating at 3,500 RPM, and then with 3.6 grams of zinc stearate for another 6 minutes at the impeller speed of 3,000 rpm. The latter blending was continued until the volume resistivity of the prepared encapsulated toner was $1\times10^5$ ohm-cm. After dry blending, the toner was further screened through a 63 micron sieve.

The resulting prepared toner was evaluated in a Delphax S6000 printer. The images developed were transfixed, simultaneous transfer and fix at 55° C. with a transfix pressure of 2,000 psi. Print quality was evaluated from a checkerboard print patter. The image optical density was measured with a standard integrating densitometer. Image fix was measured by the standardized tape pull method, and is expressed as a percentage of the retained image optical density after the tape test relative to the original image optical density. Image smearing was evaluated qualitatively by rubbing the fused checkerboard print with a blank paper under an applied force for a specific cycle time, and viewing the surface cleanliness of nonprinted and printed areas of the page. Image ghosting was evaluated visually. For this toner, the image fix level was 95 percent, and no image smear and no image ghosting were observed after 2,000 prints.

EXAMPLE II

The preparation of a 15.9 micron conductive black encapsulated toner with a fluorocarbon-incorporated poly(lauryl methacrylate) core copolymer binder was prepared as follows.

A mixture of 103 grams of lauryl methacrylate, 11.4 grams of Zonyl TM fluorocarbon, 2.85 grams each of 2,2'-azobis-(isobutyronitrile) and 2.85 grams of 2,2'-azobis-(2,4-dimethylvaleronitrile), and 47.1 grams of Isonate 143 L was mixed by high shear blending using a Brinkmann polytron equipped with a PT 35/4 probe at 4,000 RPM for 30 seconds. To the resulting clear organic mixture was added 300 grams of Magnox magnetite TMB-100, and the resulting mixture was homogenized for 3 minutes at 8,000 RPM with the Brinkmann probe. One liter of 0.12 percent (by weight) of an aqueous poly(vinyl alcohol) was added, and the mixture was homogenized at 9,000 RPM for 2 minutes using an IKA polytron equipped with a T45/4G probe. To the resulting suspension was added a solution of 37 milliliters of 1,4-bis(3-aminopropyl)piperazine in 80 milliliters of water, and the resulting mixture was transferred to a 3-liter reaction kettle equipped with a mechanical stirrer and a temperature probe. The mixture was stirred at room temperature for 1 hour, and was subsequently heated in an oil bath over a period of 1 hour to a final reaction temperature of 85° C. Heating was continued at this temperature for an additional 6 hours. The reaction mixture was then worked up according to the procedure of Example I except that 18.3 grams instead of 21.2 grams of Aquadag E were employed during the spray-drying stage. Three hundred and fifty (350) grams of the dry encapsulated toner were obtained, and the volume average particle diameter of this toner was 15.9 microns with a volume average particle size dispersity of 1.34. The toner was then dry-blended to yield a final volume resistivity of $3\times10^5$ ohm-cm, and this toner was then evaluated in a Delphax S6000 printer in accordance with the procedure of Example I. The toner exhibited a fix level of 93 percent with no image smear and no image ghosting for 2,000 prints.

EXAMPLE III

A 14.5 micron conductive black encapsulated toner with a fluorocarbon-incorporated poly(lauryl methacrylate) copolymer core binder was prepared by the following procedure.

The toner was prepared in accordance with the procedure of Example I except that 108.5 grams of lauryl methacrylate, 5.7 grams of Zonyl TM, 2.85 grams each of 2,2'-azobis-(2,4-dimethylvaleronitrile) and 2,2'-azobis-(isobutyronitrile), and 300 grams of Bayferrox 8610 were employed in place of, respectively, 120 grams of lauryl methacrylate, 13.3 grams of Zonyl TM, 3.30 grams each of 2,2'-azobis-(2,4-dimethylvaleronitrile), 2,2'-azobis-(isobutyronitrile), and 280 grams of NP-608. In addition, 1 liter of 0.16 percent (by weight) of an aqueous solution of poly(vinyl alcohol) instead of 0.18 percent poly(vinyl alcohol) solution was selected. Three hundred and seventy-five (375) grams of dry encapsulated toner were obtained, and the toner's volume average particle diameter was 14.5 microns with a volume average particle size dispersity of 1.31. This toner was machine tested in a Delphax S6000 printer according to the procedure of Example I, and substantially similar results were obtained.

EXAMPLE IV

A 17.8 micron conductive black encapsulated toner comprising a fluorocarbon-incorporated poly(lauryl acrylate) copolymer core binder was prepared as follows.

The toner was prepared in accordance with the procedure of Example I except that lauryl acrylate and Zonyl TA-N were utilized in place of lauryl methacrylate and Zonyl TM. In addition, 280 grams of Magnox magnetite TMB-100 were employed instead of NP-608, and the concentration of poly(vinyl alcohol) was 0.13 percent. A total of 336 grams of dry encapsulated toner product was obtained. The toner volume average particle diameter was 17.8 with a volume average particle size dispersity of 1.29. This toner was evaluated in a Xerox Corporation 4060 TM printer according to the procedure of Example I and substantially similar results were obtained.

EXAMPLE V

The following example illustrates the preparation of a 13.5 micron conductive black toner comprising a fluorocarbon-incorporated poly(lauryl acrylate-stearyl acrylate) copolymer core binder.

The toner was prepared in accordance with the procedure of Example I except that 60 grams each of lauryl acrylate and stearyl acrylate were utilized in place of 120 grams of lauryl methacrylate. In addition, 0.25 percent of an aqueous poly(vinyl alcohol) solution was utilized in place 0.18 percent aqueous poly(vinyl alcohol) solution. Three hundred and forty-seven (347) grams of encapsulated dry toner were obtained with a volume average particle diameter of 13.5 microns and a volume average particle size dispersity of 1.37. This toner was machine tested in a Delphax S6000 printer by repeating the procedure of Example I, and substantially similar results were obtained.

EXAMPLE VI

The following example illustrates the preparation of a 14.1 micron insulating black encapsulated toner comprising a fluorocarbon-incorporated poly(lauryl methacrylate-n-butyl methacrylate) copolymer core binder.

The toner was prepared in accordance with the procedure of Example I with 150 grams of lauryl methacrylate, 50 grams of n-butyl methacrylate, and 4.0 grams each of 2,2'-azobis-(2,4-dimethylvaleronitrile) and 2,2'-azobis-(isobutyronitrile) in place of 120 grams of lauryl methacrylate and 3.30 grams each of 2,2'-azobis-(2,4-dimethylvaleronitrile) and 2,2'-azobis-(isobutyronitrile). In addition, 200 grams of Columbian magnetite Mapico Black and 0.26 percent of aqueous poly(vinyl alcohol) solution were employed instead of, respectively, 280 grams of NP-608 and 0.18 percent of aqueous poly(vinyl alcohol) solution. Furthermore, the wet toner was spray dried without Aquadag E, and dry-blended with zinc stearate without the carbon black providing a slightly insulating toner. Three hundred and fifty-one (351) grams of dry encapsulated toner were obtained with a volume average particle diameter of 14.1 and a volume average particle size dispersity of 1.34. This toner was machine tested in a xerographic imaging test fixture wherein images were developed with the above prepared toner, transferred to a paper substrate, and subsequently pressure fixed with a suitable pressure roll. The image fix level was 85 percent with clean image background, and no toner or image offset to the pressure roll.

EXAMPLE VII

A 16.1 micron blue encapsulated toner comprising a fluorocarbon-incorporated poly(lauryl methacrylate-stearyl methacrylate) copolymer core binder was prepared as follows.

The toner was prepared in accordance with the procedure of Example VI except that 200 grams of lauryl methacrylate and 50 grams of stearyl methacrylate were selected for the core binder. In addition, 125 grams of Degussa Aerosil and 20 grams of copper phthalocyanine were utilized in place of 200 grams of Mapico Black. Furthermore, the wet toner was spray dried without Aquadag E, and dry blended with zinc stearate without the carbon black. Three hundred and fifty-five (355) grams of encapsulated dry toner were obtained with a volume average particle diameter of 16.1 and a volume average particle size dispersity of 1.41. The toner was tested by repeating the procedure of Example VI, and substantially similar results were obtained.

EXAMPLE VIII

A 13.2 micron conductive black encapsulated toner with a fluorocarbon-incorporated poly(lauryl methacrylate-n-hexyl methacrylate) copolymer core binder is prepared by the following procedure.

The toner was prepared in accordance with the procedure of Example I except that 100 grams of lauryl methacrylate, 20 grams of hexyl methacrylate, and Pfizer magnetite MCX 6368 were employed instead of 120 grams of lauryl methacrylate and NP-608. In addition, 1 liter of 0.20 percent (by weight) of an aqueous solution of poly(vinyl alcohol) instead of 0.18 percent of poly(vinyl alcohol) solution was selected. Three hundred and sixty-four (364) grams of an encapsulated dry toner were obtained, and the toner's volume average particle diameter was 13.2 microns with a volume average particle size dispersity of 1.33. Evaluation of this toner was conducted in a Delphax S6000 printer according to the procedure of Example I, and substantially similar results were obtained.

Other modifications of the present invention may occur to those skilled in the art based subsequent to a review of the present application, and these modifications, including equivalents thereof, are intended to be included within the scope of the present invention.

What is claimed is:

1. An encapsulated toner composition comprised of a core comprised of the reaction product of a fluorocarbon with a polymer and wherein said core is derived from the copolymerization of an addition-type monomer and a functionalized fluorocarbon compound represented by Formula (I):

$$A-(CF_2)_x-B \quad (I)$$

wherein A is a structural moiety containing an addition-polymerization functional group; B is a fluorine atom or a structural moiety containing an addition-polymerization functional group; and x is the number of difluoromethylene functions; pigment or dyes; and a polymeric shell.

2. A toner in accordance with claim 1 wherein the addition-type monomer is an acrylate, methacrylate, or styrene monomer.

3. A toner in accordance with claim 1 wherein the pigment is carbon black, magnetite, or mixtures thereof.

4. A toner in accordance with claim 3 wherein the magnetite is Mapico Black.

5. A toner in accordance with claim 1 wherein the pigment is cyan, yellow, magenta, red, green, blue, brown, or mixtures thereof.

6. A toner in accordance with claim 5 wherein the pigment is Heliogen Blue, Pylam Oil Blue, Pylam Oil Yellow, Pigment Blue 1, Pigment Violet 1, Pigment Red 48, Lemon Chrome Yellow DCC 1026, E.D. Toluidine Red, Bon Red C, NOVAperm Yellow FGL, Hostaperm Pink E, Cinquasia Magenta, 2,9-dimethyl-substituted quinacridone, anthraquinone dye, Cl Dispersed Red 15, Cl Solvent Red 19, copper tetra-(octadecyl sulfonamido) phthalocyanine, x-copper phthalocyanine, Cl Pigment Blue, Anthrathrene Blue, Special Blue X-2137, 3,3-dichlorobenzidene acetoacetanilides, a monoazo pigment, Cl Solvent Yellow 16, a nitrophenyl amine sulfonamide, Cl Dispersed Yellow 33, 2,5-dimethoxy-4-sulfonanilide phenylazo-4'-chloro-2,5-dimethoxy acetoacetanilide, Permanent Yellow FGL or mixtures thereof.

7. A toner in accordance with claim 1 wherein the shell comprises from about 5 percent to about 30 percent by weight of the toner, the core resin binder comprises from about 15 percent to about 90 percent by weight of the toner, and the colorant comprises from about 5 percent to about 75 percent by weight of the toner.

8. A toner in accordance with claim 1 containing surface additives.

9. A toner in accordance with claim 8 wherein the surface additives are metal salts, metal salts of fatty acids, or colloidal silicas.

10. A toner in accordance with claim 9 wherein zinc stearate is selected.

11. A toner in accordance with claim 8 wherein the additives are present in an amount of from about 0.1 to about 5 weight percent of the toner.

12. A toner in accordance with claim 1 wherein the shell is prepared by interfacial polymerization.

13. A toner in accordance with claim 1 wherein the shell is a polyurea, a polyamide, a polyurethane, a polyester, or mixtures thereof.

14. A toner in accordance with claim 1 wherein the shell surface contains conductive components.

15. A toner in accordance with claim 14 wherein the conductive components are comprised of carbon black, graphite, or mixtures thereof.

16. A toner in accordance with claim 15 with a resistivity of from about $10^3$ to about $10^8$ ohm-cm.

17. A toner in accordance with claim 1 wherein the core is prepared by free-radical polymerization.

18. An encapsulated toner composition in accordance with claim 1 wherein A is acryloxy, methacryloxy, or styryl.

19. A toner composition in accordance with claim 1 wherein B is a fluorine atom.

20. A toner composition in accordance with claim 1 wherein x is a number of from 1 to about 50.

21. An imaging process which comprises the generation of an image on an imaging surface, subsequently developing this image with the toner composition of claim 1, thereafter transferring the image to a suitable substrate, and permanently affixing the image thereto.

22. A toner in accordance with claim 1 wherein the core resin binder is a copolymer derived from the copolymerization of functionalized fluorocarbon compound as represented by Formulas (II), (III), (IV), or (V) wherein R is hydrogen or alkyl, R' is alkylene or arylene, and x is a number of from 1 to about 50, with n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, styrene, dodecyl styrene, hexylmethyl styrene, nonyl styrene, tetradecyl styrene or mixtures thereof.

23. An encapsulated toner composition comprised of a core comprised of the reaction product of a fluorocarbon with a polymer and wherein said core is derived from the copolymerization of an addition-type monomer and a functionalized fluorocarbon compound represented by Formulas (II), (III), (IV), or (V),

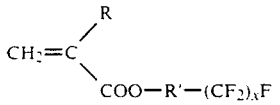

(II)

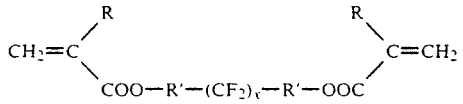

(III)

$$CH_2=CH-C_6H_5-R'-(CF_2)_x-F \quad (IV)$$

$$CH_2=CH-C_6H_5-R'-(CF_2)_x-R'-C_6H_5-CH=CH_2 \quad (V)$$

wherein R is hydrogen, or an alkyl; R′ is alkylene, arylene, or the derivatives thereof; and x represents the number of difluoromethylene functions; and pigment or dyes; and a polymeric shell.

24. A toner in accordance with claim 23 wherein R is methyl or ethyl.

25. A toner in accordance with claim 23 wherein R′ is an alkylene group containing from 1 to about 20 carbon atoms.

26. A toner in accordance with claim 23 wherein R′ is an arylene group containing from 6 to about 30 carbon atoms.

27. A toner in accordance with claim 23 wherein x is a number of from about 1 to about 30.

28. A toner in accordance with claim 23 wherein the core resin binder is a copolymer derived from the copolymerization of functionalized fluorocarbon compound of Formulas (II), (III), (IV), or (V) with n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, styrene, dodecyl styrene, hexylmethyl styrene, nonyl styrene, tetradecyl styrene or mixtures thereof.

29. A toner in accordance with claim 28 wherein the pigment is carbon black, magnetite, or mixtures thereof.

30. A toner in accordance with claim 28 wherein the pigment is cyan, yellow, magenta, red, green, blue, brown, or mixtures thereof.

31. An imaging process which comprises the generation of an image on an imaging surface, subsequently developing this image with the toner composition of claim 23, thereafter transferring the image to a suitable substrate, and permanently affixing the image thereto.

32. An encapsulated toner composition comprised of a core binder comprised of a copolymer fluorocarbon of Formula (I), wherein A is a structural moiety containing an addition-polymerization functional group; B is a fluorine atom or a structural moiety containing an addition-polymerization functional group; and x is the number of difluoromethylene functions, or wherein the fluorocarbon selected is represented by the Formulas (II), (III), (IV), or (V), wherein R is hydrogen, or an alkyl; R′ is alkylene, arylene, or the derivatives thereof; and x represents the number of difluoromethylene functions; pigment or dyes, monomer or monomers, and a shell monomer; and thereover a polymeric shell.

33. A toner in accordance with claim 32 wherein the fluorocarbon selected is represented by the Formulas (II), (III), (IV), or (V), wherein R is hydrogen, or an alkyl; R′ is alkylene, arylene, or the derivatives thereof; and x represents the number of difluoromethylene functions; and pigment or dyes; and a polymeric shell.

34. A toner in accordance with claim 32 wherein the core resin binder is comprised of the reaction product of the polymerization of the functionalized fluorocarbon and an addition monomer component.

35. A toner in accordance with claim 32 wherein the fluorocarbon contains as functional groups acrylate or methacrylate.

36. A toner in accordance with claim 17 wherein the core is comprised of the reaction product of a fluorocarbon with an acrylate, a methacrylate, a styrene, or mixtures thereof.

37. An encapsulated toner composition comprised of a copolymer fluorocarbon and a monomer component, pigment, and thereover a polymeric shell and wherein the fluorocarbon is of the following formula $$A-(CF_2)_x-B$$

wherein A is a structural moiety containing an addition polymerization functionality; B is a fluorine atom or a structural moiety containing an addition polymerization functionality; and x is the number of difluoromethylene groups.

38. An encapsulated toner composition in accordance with claim 37 wherein x is a number of from about 1 to about 50.

39. An encapsulated toner composition in accordance with claim 37 wherein A is an addition polymerization functionality selected from the group consisting of acryloxy, methacryloxy and styryl.

40. An encapsulated toner composition in accordance with claim 37 wherein the pigment particles are comprised of carbon black, magnetite or mixtures thereof, cyan, magenta, yellow, red, green, blue, brown or mixtures thereof.

41. A process for the preparation of encapsulated toner compositions which comprises admixing or dispersing a fluorocarbon compound of Formula (I), wherein A is a structural moiety containing an addition-polymerization functional group; B is a fluorine atom or a structural moiety containing an addition-polymerization functional group; and x is the number of difluoromethylene functions, or wherein the fluorocarbon selected is represented by the Formulas (II), (III), (IV), or (V), wherein R is hydrogen, or an alkyl; R′ is alkylene, arylene, or the derivatives thereof; and x represents the number of difluoromethylene functions; pigment or dyes, monomer or monomers, and a shell monomer, into stabilized microdroplets in a aqueous medium; followed by microcapsule shell formation around the microdroplets by interfacial polycondensation; and subsequently initiating free-radical polymerization within the formed microcapsules thereby generating a core comprised of a fluorocarbon-incorporated resin copolymer binder containing pigment or dyes encapsulated in a polymeric shell.

* * * * *